US005725666A

United States Patent [19]

Baumlin

[11] Patent Number: 5,725,666

[45] Date of Patent: Mar. 10, 1998

[54] APPARATUS FOR IMPROVING THE UNIFORMITY OF A LIQUID CURTAIN IN A CURTAIN COATING SYSTEM

[75] Inventor: Jean-Marie Baumlin, Chalon sur Saone, France

[73] Assignee: Eastman Kodak Company, Rochester, N.Y.

[21] Appl. No.: 643,836

[22] Filed: May 7, 1996

[30] Foreign Application Priority Data

May 19, 1995 [FR] France ..... 95 0006269

[51] Int. Cl.[6] ..... B05C 5/00

[52] U.S. Cl. ..... 118/324; 118/300; 118/325; 118/DIG. 4; 427/420

[58] Field of Search ..... 118/324, 325, 118/DIG. 4; 427/420

[56] References Cited

U.S. PATENT DOCUMENTS

| | | | |
|---|---|---|---|
| 3,632,374 | 1/1972 | Greiller | 117/34 |
| 3,867,901 | 2/1975 | Greiller | 118/50 |
| 3,958,532 | 5/1976 | Timson | 118/325 |
| 4,109,611 | 8/1978 | Fahrni et al. | 118/325 |
| 4,510,882 | 4/1985 | Prato | 118/300 |
| 5,462,598 | 10/1995 | Servant et al. | 118/324 |

FOREIGN PATENT DOCUMENTS

| | | |
|---|---|---|
| 92/11095 | 7/1992 | WIPO . |
| 9211095 | 7/1992 | WIPO . |

*Primary Examiner*—Donald E. Czaja
*Assistant Examiner*—Michael P. Colaianni
*Attorney, Agent, or Firm*—Arthur H. Rosenstein

[57] ABSTRACT

The invention concerns an apparatus for improving the uniformity of a liquid curtain in a curtain coating system. The apparatus comprises means for, prior to the coating of the medium, forcing the liquid composition which flows on the forward face of the lip to wet the rear face of the lip of the coating device over a predetermined distance greater than the distance over which the liquid composition would naturally wet the rear face.

9 Claims, 4 Drawing Sheets

APPARATUS FOR IMPROVING THE UNIFORMITY OF A LIQUID CURTAIN IN A CURTAIN COATING SYSTEM

FIELD OF THE INVENTION

The invention concerns the field of curtain coating, and finds its application notably in the field of the coating of media by means of a photographic composition.

BACKGROUND OF THE INVENTION

The technique of curtain coating is a technique which has already been widely used in the photographic industry. Typically, a curtain coating device comprises a feed system in the form of one or more slots fed with photographic emulsion and from which the photographic emulsion flows in the form of one or more layers which are superposed on a slightly inclined flow plane. The photographic layers then flow onto a lip, where they leave the coating device to form a liquid curtain in substantially vertical free fall, which is deposited on a moving medium (driven, for example, by means of a motorized cylinder). Schematically, the lip is substantially vertical and has a front face on which the layers of photographic emulsion flow, and a rear face forming, with respect to the front face, an angle which is typically around 30° to 45°. The bottom ends of the front face and of the rear face are separated by a chamfer, the width of which varies overall between 0.2 mm and 2.5 mm. For applications of this type, the flow rates (per unit of width of the lip) vary from 0.6 $cm^3$/s.cm to 6 $cm^3$/s.cm. The viscosity of the photographic layers varies from 0.03 to 3 poise. All these quantities are, of course, mentioned only by way of indication.

Such curtain coating systems have been the subject of numerous publications in the patent literature. By way of example, reference can be made to the patents EP-A-107 818, U.S. Pat. No. 4,510,882, U.S. Pat. No. 3,632,374, U.S. Pat. No. 3,867,901 and FR-A-2 346 057.

One of the problems to which such a system is sensitive (notably for photographic applications for which uniformity of coating is essential) relates to the uniformity and homogeneity of the curtain. This is because a non-uniform curtain creates streaks on the photographic product, that is to say variations in thickness across the width of the medium. These variations have a substantial effect on the sensitometric properties of the film and consequently it is important to minimize them as much as possible.

Various approaches have been used to minimize problems related to the non-uniformity of the curtain. Amongst these, it has been proposed to modify the design of the coating lip, or to modify the flow rates or the viscosity of the compositions to be deposited on the medium. The benefits of these solutions are often limited and are, furthermore, often obtained to the detriment of other parameters in the system.

SUMMARY OF THE INVENTION

Thus one of the objects of the present invention is to provide a method and a device which appreciably improve the uniformity of a liquid curtain in a curtain coating device.

Other objects of the present invention will emerge in detail in the description that follows.

The invention is based, to a large extent, on the observation that one of the reasons giving rise to the appearance of streaks in the curtain is a result of the non-uniformity of the wetting of the rear face of the lip. The invention therefore proposes a simple method and device which enable the uniformity of the wetting of the rear face of the lip to be improved substantially.

These objects are achieved by providing a method consisting, prior to the coating of the said medium, of forcing the liquid composition to wet the said rear face of the lip over a predetermined height greater than the height over which the liquid composition would naturally wet the said rear face.

According to one aspect of the method according to the invention, the forced wetting of the rear face of the lip over the said predetermined height comprises the following steps:

a) applying to the lip a device having two parts forming between them an angle substantially equal to the angle formed by the front face with respect to the rear face so as to be applied respectively to the said front and rear faces, the part of the device facing the rear face of the lip having a height at least equal to the said predetermined height; and b) sliding the device over substantially the whole width of the lip.

According to the present invention, an apparatus is also produced which comprises means for, prior to the coating of the said medium, forcing the liquid composition to wet the said rear face of the lip over a predetermined height greater than the height over which the liquid composition would naturally wet the said rear surface.

According to one important characteristic of the invention, the means for forcing the liquid composition to wet the said rear face of the lip over a predetermined height comprise an element having a surface designed to be applied to the rear face of the lip, the said surface having a height at least equal to the said predetermined distance, means being provided for sliding the said surface over substantially the whole width of the lip.

According to a preferred embodiment of the apparatus according to the invention, the means for forcing the liquid composition to wet the said rear face of the lip over a predetermined height include two parts forming between them an angle substantially equal to the angle formed by the front face with respect to the rear face so as to be applied respectively to the said front and rear faces, the part of the device facing the rear face of the lip having a height at least equal to the said predetermined distance, means being provided for sliding the apparatus over substantially the whole width of the lip.

Advantageously, the rear part has two fingers disposed respectively at each of the edges of the apparatus, each of the fingers having a surface designed to face the rear face of the lip.

Also advantageously, the means for sliding the apparatus over substantially the whole width of the lip comprise:

i) a carriage able to move in translation in front of the lip over substantially the whole of its width;

ii) a motor for driving the carriage; and iii) a coupling member for coupling the apparatus to the carriage.

BRIEF DESCRIPTION OF THE DRAWINGS

These objects of the invention, and others, will appear in detail in the description which follows, with reference to the drawings in which.

DETAILED DESCRIPTION OF THE PREFERRED EMBODIMENT

Figure 1:
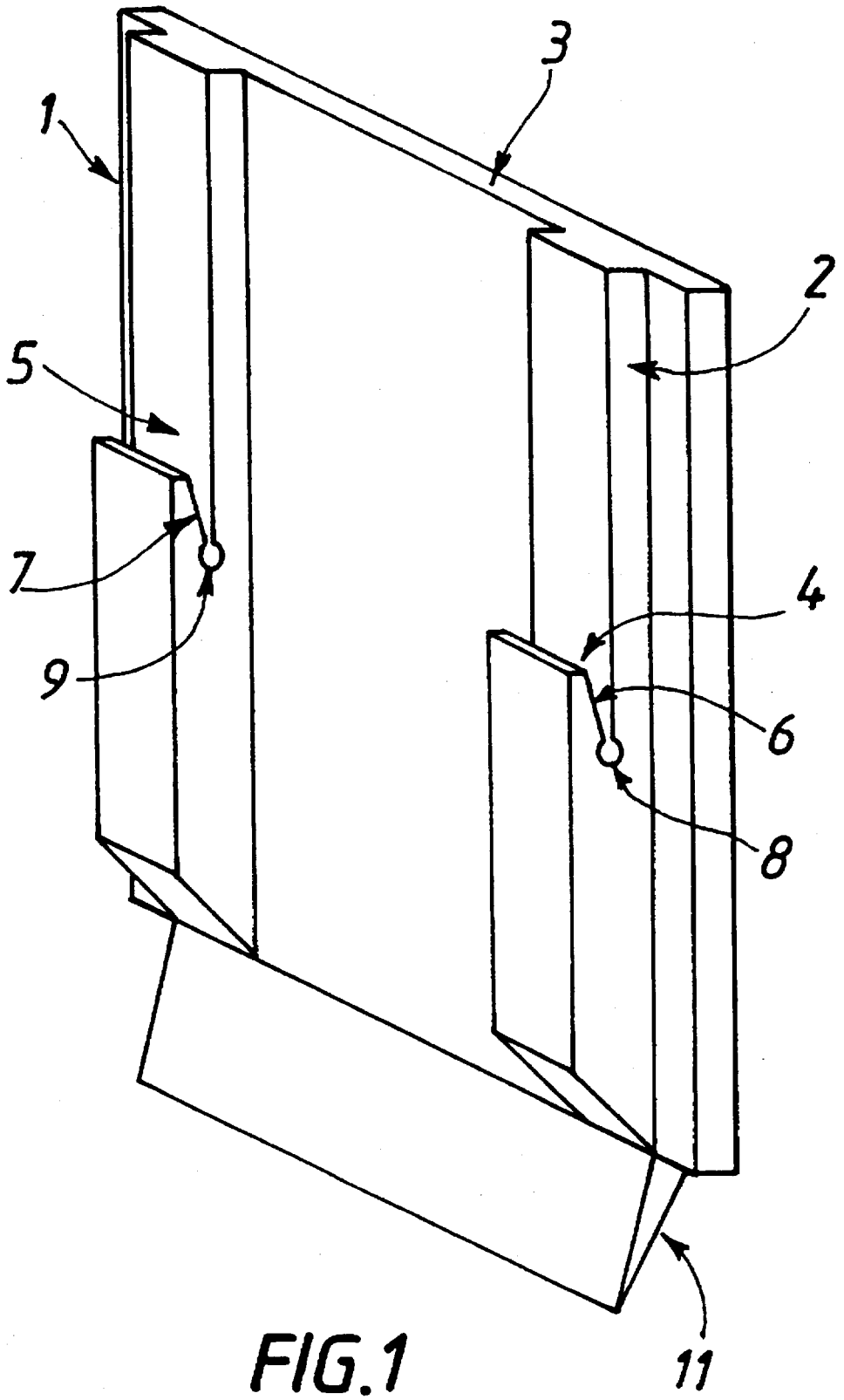
FIG. 1 depicts a perspective view of a preferred embodiment of the device according to the present invention.
Figure 2:
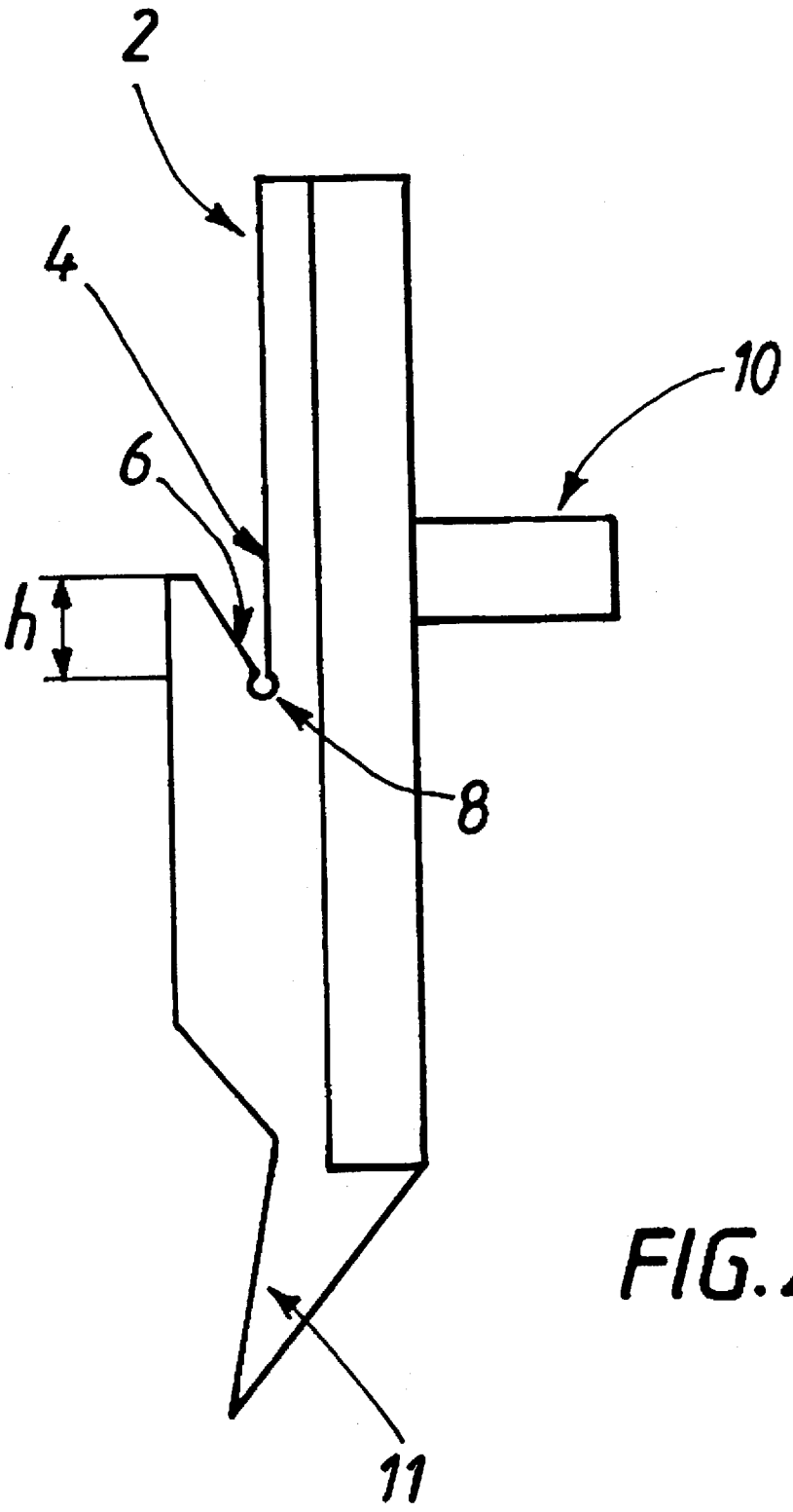
FIG. 2 depicts a side view of the device depicted in FIG. 1.

FIGS. 1 and 2, to which reference is now made, illustrate diagrammatically a preferred embodiment of the device according to the invention. The invention is based principally on the fact that, in order to obtain a uniform wetting of the rear face of the lip, the liquid must be forced to wet the face over a height greater than the height over which the liquid would naturally wet the said face, and this over substantially the whole width of the lip. Afterwards, the liquid falls under the effect of gravity to its natural wetting height, uniformly over the whole width of the lip.

As can be seen in FIG. 1, the device comprises principally two fingers 1 and 2 mounted on a frame 3, substantially level with each edge of the frame. Advantageously, each of the fingers forms a single piece with the frame 3. Each of the fingers 1, 2 defines a first surface 4, 5 designed, as will be described in greater detail with reference to FIG. 3, to be brought to bear on the front face of the lip of the coating device, and a second surface 6, 7 designed to be applied substantially to the rear face of the lip. The first surface forms, with respect to the second, an angle substantially equal to the angle formed by the front face of the lip with respect to the rear face, and is preferably disposed in facing relationship with the second. Generally, the angle between the two surfaces varies from 30° to 45°. The height of the rear surface 6, 7 of each of the fingers is at least equal to the height over which it is intended that the liquid should wet the rear face. Typically, the height h of the rear surface is around 4 mm for a natural wetting height which can be up to 1 mm, which produces a difference in wetting height of around 3 mm for a photographic composition, for which an order of magnitude of viscosity was mentioned previously.

Advantageously, and as can be seen in FIG. 1, each of the fingers has, at the junction between the front 4, 5 and rear 6, 7 surfaces, a substantially cylindrical recess 8, 9 designed to receive the bottom end of the lip. This characteristic minimizes the risk of damage to the chamfer, and is particularly advantageous when the width of the chamfer is very small (0.1 to 0.3 mm).

Numerous materials can be used to produce the device according to the present invention. However, the material forming the surfaces in contact with the lip is preferably chosen so as not to damage or scratch the lip. This is, indeed, critical when it is used for a device designed for the coating of a photographic composition on a medium. By way of example, plastic materials are used.

As can be seen in FIG. 2, the device according to the invention has a handle 10 designed for its handling by an operator in order, having applied it to the lip of the coating device, to slide it over the lip so as to cause it to travel at least once over substantially the whole width of the lip. Advantageously, several passages of the device over the lip are undertaken.

Other arrangements can, of course, be used to move the device of the invention over the lip. By way of example, as shown in FIG. 4 a carriage 12 is used, driven by a motor 13, shown in FIGS. 3 and 4 and able to move in translation in front of the lip and over its whole width. The device and/or the carriage comprise means for coupling one to the other 14 so as to be able to confer on the wetting device the sliding movement described above.

The wetting device depicted in FIGS. 1 and 2 comprises in its lower part a portion 11 designed so as to minimize splashes of liquid onto an operator in front of the curtain. The portion 11 is, in fact, oriented so as to deflect the liquid towards the rear of the curtain. This characteristic is not, of course, necessary when the wetting device is driven automatically on the lip.

According to the embodiment depicted, the wetting device has two fingers (whose width is approximately 7 mm) so as to assist the guiding of the wetting device on the lip. The fingers are respectively situated approximately 5 mm away from the corresponding edge, and separated by a distance of approximately 55 mm. Alternatively, a single finger could be used.

Similarly, it should be noted that the front surface of the wetting device does not actually participate in the wetting of the rear surface of the lip, but participates essentially in guiding the apparatus over the lip, notably when it is manually controlled. According to an alternative, an element having a plane surface designed to be applied to the rear face of the lip is used, the said element being mounted on a carriage to the rear of the lip and driven in translation by a motor so that the said surface sweeps the width of the lip. This approach eliminates the problems related to the use of surfaces in front of the lip which interfere with the curtain, giving rise to splashing on the adjacent parts of the coating device.

Figure 3:
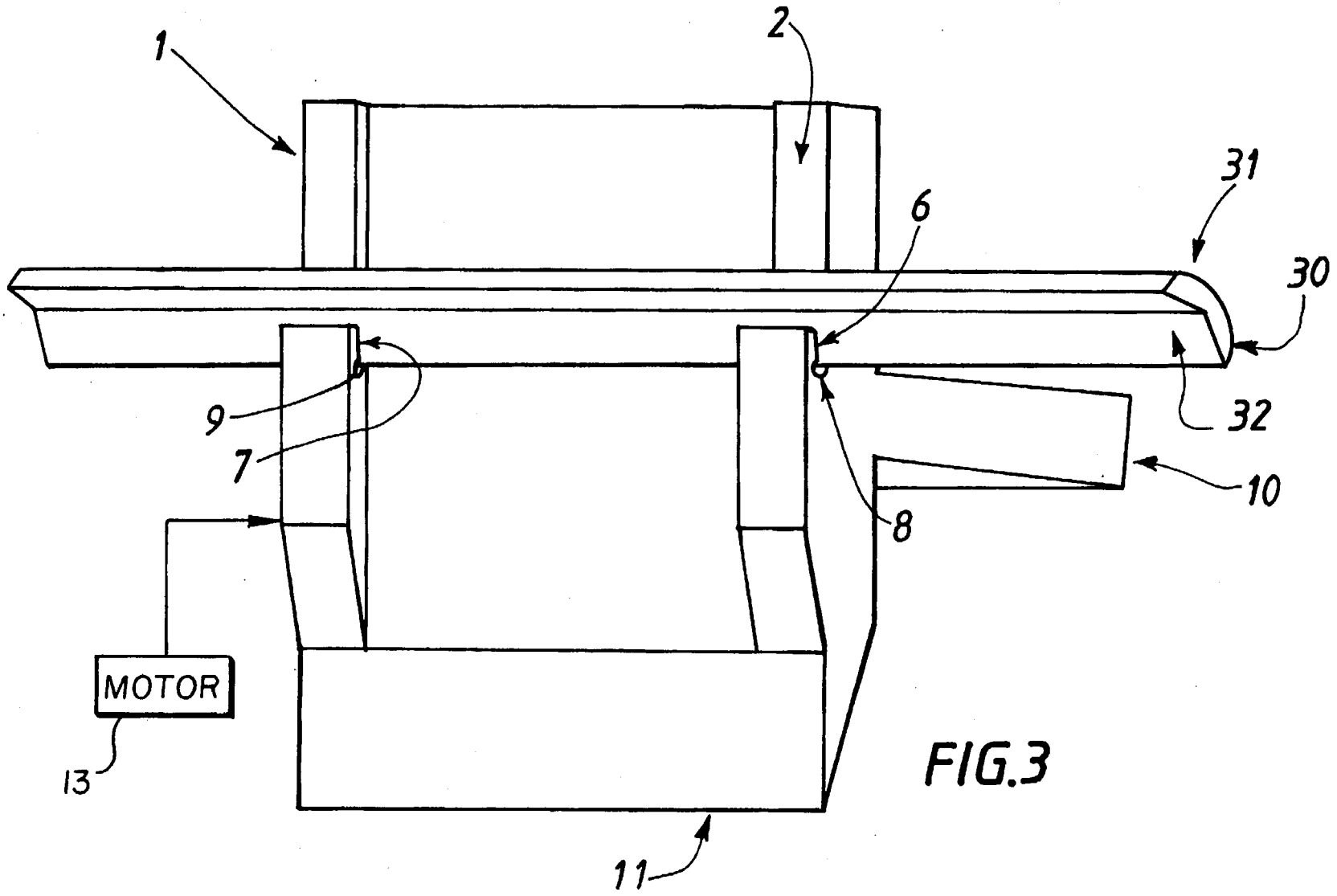
FIG. 3 depicts a perspective view of a curtain coating system to which the device according to the invention is applied.
Figure 4:
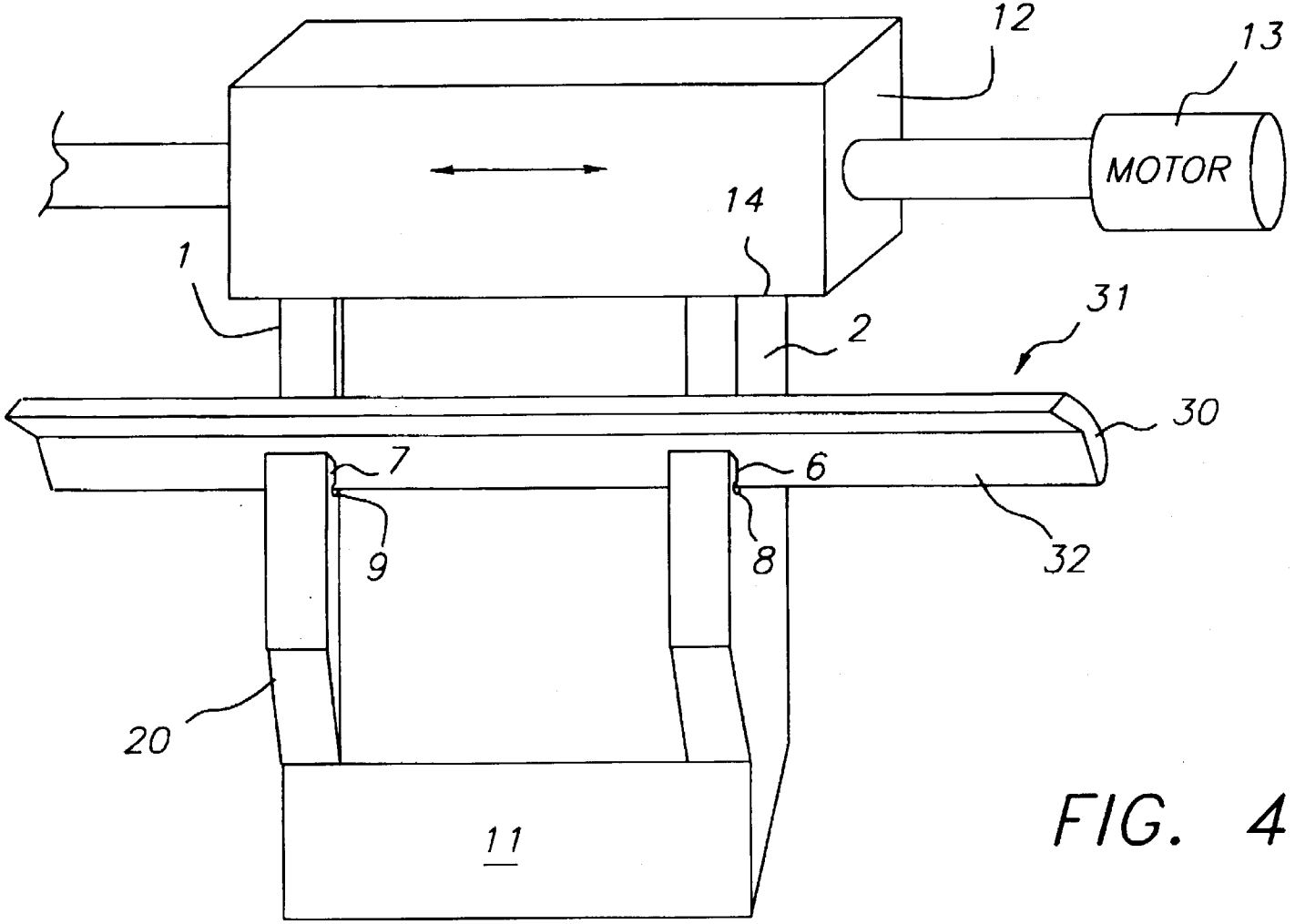
FIG. 4 depicts a perspective view of a curtain coating system containing a carriage, motor and coupling member.

FIG. 3, to which reference is now made, depicts a perspective view of a curtain coating device to which there is applied a wetting device of the same type as that which has just been described with reference to FIGS. 1 and 2. As is depicted, the front surface 4, 5 of each of the fingers 1, 2 bears against the front face 30 of the lip 31. The rear surface 6, 7 of each of the fingers is applied opposite the rear face 32 of the lip so as to force the liquid to wet the said rear face over a height greater than its natural wetting height.

The wetting device according to the invention is preferably used at the start of each new coating cycle, during the period of preparation of the curtain, prior to the start of the process of coating the medium, its use in the course of the coating process being made difficult (notably for certain applications) by the disturbance that it produces in the curtain.

The wetting device according to the invention is particularly advantageous in that it affords uniform wetting of the rear of the lip, and this in a reproducible manner. Furthermore, its use does not dirty the lip, which could be crippling for certain applications.

The invention has just been described with reference to preferred embodiments of the invention. It is obvious that variants can be made thereto without departing from the spirit of the invention as claimed hereinafter.

I claim:

1. Apparatus for improving the uniformity of a liquid curtain in a coating device comprising a lip at which a liquid composition to be coated on a medium leaves the coating device to form a vertical curtain in free fall, the lip comprising a front face on which the liquid composition flows by gravity, and a rear face, the lip having a length measured transversally to the flow of said liquid composition; the apparatus comprising means for, prior to the coating of the medium, forcing the liquid composition which flows over the front face of the lip to wet the rear face of the lip over a predetermined distance greater than the distance over which the liquid composition would naturally wet the rear face.

2. Apparatus according to claim 1, wherein the means for forcing the liquid composition to wet the rear face of the lip over a predetermined distance comprise an element having a surface designed to be applied to the rear surface of the lip, the surface having a distance at least equal to the predetermined distance, and means for moving the surface over substantially the whole length of the lip.

3. Apparatus according to claim 2, wherein the means for forcing the liquid composition to wet the rear face of the lip over a predetermined distance include two parts forming between them an angle substantially equal to the angle formed by the front face with respect to the rear face so as to be applied respectively to the front and rear faces, the part of the device facing the rear face of the lip having a distance at least equal to the predetermined distance means are provided for sliding the apparatus over substantially the whole length of the lip.

4. Apparatus according to claim 3, wherein the rear part has two fingers disposed respectively at each edge of the apparatus, each of the fingers having a surface designed to face the rear face of the lip.

5. Apparatus according to claim 3, wherein the means for sliding the device over substantially the whole length of the lip comprise a handle enabling the apparatus to be handled by an operator.

6. Apparatus according to claim 3, wherein it additionally comprises means for minimizing splashes of liquid onto the operator in front of the curtain, the lower part of the means being designed so as to deflect the free falling liquid towards the rear of the curtain prior to the coating of the medium.

7. Apparatus according to claim 2, wherein the means for sliding the apparatus over substantially the whole length of the lip comprise:

i) a carriage movable in translation opposite the lip over substantially the whole of its length;

ii) a motor for driving the carriage; and iii) a coupling member for coupling the apparatus to the carriage.

8. Apparatus according to claim 1, wherein the parts in contact with the lip are made of plastic.

9. Apparatus according to claim 1, wherein the front and rear parts are situated substantially opposite each other, the bottom ends of the front and rear parts being joined together in a substantially cylindrical recess designed to receive the bottom end of the lip.

* * * * *